US010674882B2

(12) United States Patent
Mathiassen et al.

(10) Patent No.: US 10,674,882 B2
(45) Date of Patent: Jun. 9, 2020

(54) ADAPTER PLATE

(71) Applicant: NILFISK A/S, Broendby (DK)

(72) Inventors: Henrik Mathiassen, Arhus C (DK); Steen Klimt Johannesen, Aabybro (DK); Thomas Elmer, Aalborg (DK); Trine Baek Nielsen, Støvring (DK)

(73) Assignee: NILFISK A/S, Broendby (DK)

( * ) Notice: Subject to any disclaimer, the term of this patent is extended or adjusted under 35 U.S.C. 154(b) by 357 days.

(21) Appl. No.: 15/512,362

(22) PCT Filed: Sep. 15, 2015

(86) PCT No.: PCT/EP2015/001839
§ 371 (c)(1),
(2) Date: Mar. 17, 2017

(87) PCT Pub. No.: WO2016/041631
PCT Pub. Date: Mar. 24, 2016

(65) Prior Publication Data

US 2017/0273519 A1 Sep. 28, 2017

(30) Foreign Application Priority Data

Sep. 19, 2014 (DE) ..... 10 2014 013 633

(51) Int. Cl.
*A47L 9/00* (2006.01)
*B65D 25/20* (2006.01)

(52) U.S. Cl.
CPC ..... *A47L 9/0018* (2013.01); *B65D 25/20* (2013.01)

(58) Field of Classification Search
CPC ..... A47L 9/0018; A47L 9/0009; A47L 9/00; A47L 9/0027; A47L 9/26; A47L 9/2868; A47L 7/009; B65D 25/20
USPC ..... 15/246.2, 327.1–327.2
See application file for complete search history.

(56) References Cited

U.S. PATENT DOCUMENTS 6,044,519 A * 4/2000 Hendrix ..... A47L 9/2805 15/319
7,513,464 B1 * 4/2009 Berfield ..... A47L 9/0036 15/323
2010/0122427 A1 5/2010 Ichikawa et al.
2013/0031731 A1 2/2013 Hess et al.

FOREIGN PATENT DOCUMENTS

DE 20218996 U1 3/2003
DE 102009010073 A1 8/2010
DE 102010003754 A1 10/2011
(Continued)

OTHER PUBLICATIONS

App. WO 2011009480 A1.*

*Primary Examiner* — Laura C Guidotti
(74) *Attorney, Agent, or Firm* — Browdy and Neimark, PLLC

(57) ABSTRACT

An adapter device for arranging a container (4, 6) on the upper face (5) of a cleaning device (9), said adapter device consisting of an adapter plate (1, 2) with a support surface (13, 15) and at least one locking element for locking the container in place on the (4, 6) adapter plate. The adapter plate (1, 2) is divided into at least two parts and consists of a front adapter plate (1) and a rear adapter plate (2) which can be separately mounted on the upper face (5) of the cleaning device (9).

14 Claims, 6 Drawing Sheets

(56) References Cited

FOREIGN PATENT DOCUMENTS

| | | | | | |
|---|---|---|---|---|---|
| DE | 102012108650 | A1 | 3/2014 | | |
| EP | 2456341 | B1 | 9/2013 | | |
| WO | WO-2011009480 | A1 * | 1/2011 | ..... | A47L 9/0009 |

* cited by examiner

ADAPTER PLATE

The object of the invention is an adapter device for arranging containers on a cleaning device.

Such an adapter device for arranging on a cleaning device is known, for example, from EP 2 456 341 B1. This adapter device is mounted on the housing of a cleaning device and is provided on the upper face with a support surface for housing a container. Such a container is fixed on the adapter plate by means of a locking device and is therefore connected with the housing of the cleaning device through the adapter plate. Such a container may be a tool box, which may be transported in combination with the cleaning device.

The adapter plate disclosed in EP 2 456 341 B1 has a center transporting handle, which may be rotated out of a recess in the adapter plate by means of a tilting mechanism, in order to lift the adapter plate together with the cleaning device.

A drawback of this known arrangement is however the fact that the adapter plate, which is mounted on the cleaning device, has to have a large surface, in order to accommodate a corresponding container. The adapter plate therefore covers the entire upper face of the cleaning device. If now a cleaning device has to be lifted and transported, it is required to tilt the transporting handle, which is integrated in the adapter plate, outward, in order to lift the cleaning device through it. Since the adapter plate disclosed in EP 2 456 341 B1 is fixed without the use of tools to the surface of the adapter plate, there is no reliable connection between adapter plate and cleaning device. Therefore it cannot be ruled out that the connection—in particular during transport of apparatus by means of the handle fixed to the adapter plate—loosens and the adapter plate therefore rises from the surface of the adapter plate and the adapter plate inadvertently falls during transport from a raised position to the ground. Due to the tool-free mounting of the adapter plate onto the cleaning device and the placing of the transport handle o the adapter plate, there is no resilient connection with the cleaning device, through which a transmission of force between the transport handle may be ensured.

Normally such transport handles are positioned on the upper face of the housing of the cleaning device. Such an already known transport handle is however rendered ineffective by the attached adapter plate, which causes a weight increase.

A further drawback are the high production costs of disclosed adapter plate, since in this case, due to the dimensions of the adapter plate, a conspicuous quantity of material is required. Moreover, the cleaning device is unnecessarily heavy with an increased load on the housing and the wheels on the underside of the cleaning device.

The object of the invention is therefore to develop an adapter plate of above said type, so that an improved handling of the cleaning device may be achieved.

The invention achieves this object by the characteristics of valid claim 1.

The fundamental characteristic lies in the fact that the adapter plate is at least divided in two parts, in particular a front adapter plate and a rear adapter plate, which may be mounted, separated from each other, on the upper face of a cleaning device, without using tools or with a tool and that both adapter plates leave the housing surface with the transport handle free between them.

The invention should however not be construed as limited to a two-part adapter plate, whereby a three-part or multipart adapter plate is also claimed.

Due to the splitting of the adapter plate in two parts it is possible to mount the adapter plates separately from each other on a cleaning device depending on the requirements. The orientation of both adapter plates may be either transversal to the housing longitudinal axis or parallel to the housing longitudinal axis. It is however important that the adapter plates provide access to the transport handle on the housing side.

In this way the weight of both adapter plates is lower than a monolithic continuous adapter plate according to the state of the art. The transport handle on the housing side may always be used, so that the connection between the adapter plates and the housing has not been designed for a relatively high housing weight.

The invention also provides a higher degree of freedom in combining two different adapter plates.

In such an embodiment of the invention different containers may be mounted on the adapter plate parts. On the front or rear adapter plate a container for small parts and on the rear adapter plate a holding container for a machine may be provided, for example, which, in combination with the cleaning device, processes the small parts.

The grinding dust of a swinging grinder may for example be sucked through a cleaning device, a vacuum cleaner, for example, wherein the tool chest of the swinging grinder is provided on the rear adapter plate and the grinding pads for the swinging grinder are provided on the front adapter plate.

In this case adapter plates may be combined with each other, so that, for example, the rear adapter plate remains permanently mounted on the cleaning device, whereas the front adapter plate is adapted to the container fixed to the cleaning device according to space requirements, and therefore may be mounted in different sizes on the cleaning device.

In a further embodiment of the invention it is envisaged that the cleaning device has attachment regions for adapter plates provided on its surface, so that an adapter plate, according to requirements, is screwed in different positions on the surface of the cleaning device.

The present cleaning devices are small home appliances, which are used at home and in the industry and which may be a vacuum cleaner with a maximum power of 1100 Watt. Such a vacuum cleaner may be small, for example—and provided for suction of coarse-grained dirt particles, chips, humid dusts and liquids.

However the invention should not be limited to vacuum cleaners, wherein the mounting of the inventive adapter plates on another small electric home appliance such as a high pressure cleaning device or a generator should be possible, for example.

Due to the splitting of the adapter plate in two parts the important advantage is achieved that the transport handle, which in general is positioned in a central position on the housing surface of the cleaning device may be directly accessed. No flat adapter plate extending over the entire surface of the cleaning device covers the transport handle anymore. In this way, the cleaning device may be easily lifted and transported. Due to a direct access to the transport handle, which is integrated in the cleaning device, a direct force transmission is obtained between the transport handle and the hand of the operator of the cleaning device.

In this way, in manufacturing the adapter plate, material is reduced and the total weight of the cleaning device, a vacuum cleaner, for example, with mounted adapter plate, is generally lower than by using an integral adapter plate. The single adapter plates are mounted on the surface of the cleaning device preferably by a screwed connection, although other tool-requiring mountings may be provided.

The adapter plates according to the invention also have two differently sized receiving surfaces for receiving two differently sized containers. In this way, on the already mounted adapter plates, two differently sized containers may be mounted. According to container size, in the corresponding receiving regions different attachment means are provided. A container is preferably attached to the adapter plates by means of connection elements. Such connection elements may be provided by hooks or bracket-like locking elements, for example. These connection elements are rotatably supported on the adapter plate and engage the container.

In a further embodiment of the invention it is envisaged that the connection elements are positioned on the containers and engage corresponding openings of the adapter plate.

In a further embodiment of the invention it is envisaged that locking grooves are provided on the adapter plate, in which a corresponding formation of the container may engage to provide a fastening of the container on the adapter plate. Such a formation may be provided by locking protrusions or pins, for example. The locking groove is preferably positioned in an arcuate portion of the adapter plate. Such an arcuate portion protrudes from the adapter plate and has a central locking opening, in which a corresponding locking protrusion of container engages.

Besides the arcuate form, a polygonal form of a locking opening protruding from the adapter plate may also be provided.

The invention should however not be limited to the use of locking grooves or tiltable connection elements. Any form of attachment and fixing is claimed. It is therefore possible that the container is simply positioned on the adapter plates, and is held in the desired position only by lateral abutments.

In a further embodiment of the invention it is envisaged that the container is attached to the adapter plate by means of a locking element, wherein the adapter plate is provided with a spring-biased locking protrusion, which interacts with a locking groove of the container.

In a further embodiment of the invention the rear adapter plate has an inclined surface, which ramps down towards the transport handle. In this way a still better access to the transport handle is provided, since now no disturbing corners of the adapter plate restrict the access region.

The rear or front adapter plate may optionally have a hook-like receptacle for housing the electric cable of the cleaning device. A housing part for a corresponding suction tube may also be provided, which correspondingly protrudes from the adapter plate.

According to a further preferred embodiment of the invention, the front adapter plate or the rear adapter plate may comprise an electrically operated auxiliary device, such as for example an air compressor or a high pressure pump.

The electric auxiliary device integrated in the front or rear adapter plate may also be supplied with electricity through a socket positioned on the cleaning device.

The invention also refers to an adapter plate, which is at least split in two parts, which facilitates handling of the cleaning device and a secure transport of the cleaning device in spite of the mounted adapter plate.

The object of the present invention can be obtained not only through the object of the individual claims, but also through a combination of individual claims with each other.

All data and characteristics disclosed in documents, including the abstract, in particular the spatial configurations provided in the drawings, are claimed as inventive, as far as they are new, individually or in combination, with respect to the state of the art.

The invention is described in further detail, in the following, by means of drawings depicting only one way of putting it into practice. The drawings and the corresponding description provide further inventive characteristics and advantages of the invention.

In particular:

Figure 5:
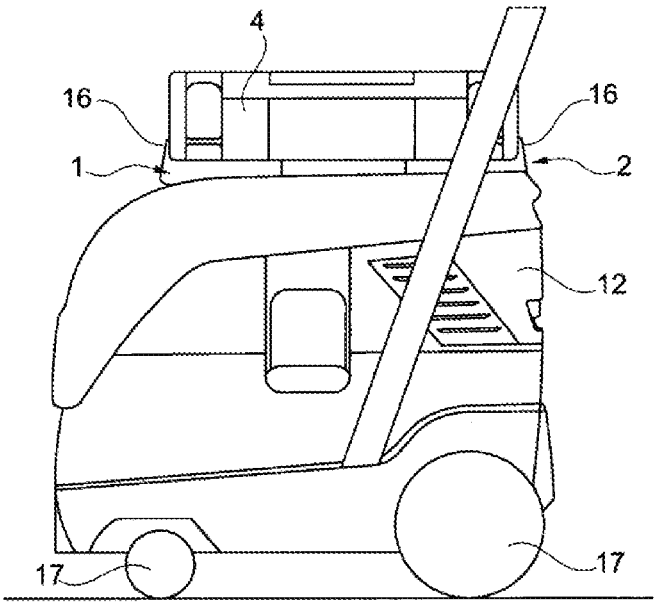
Figure 6:
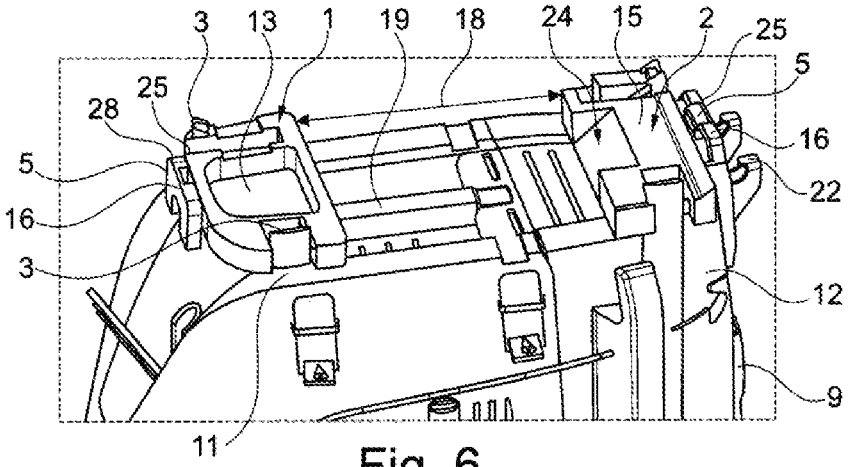
Figure 7:
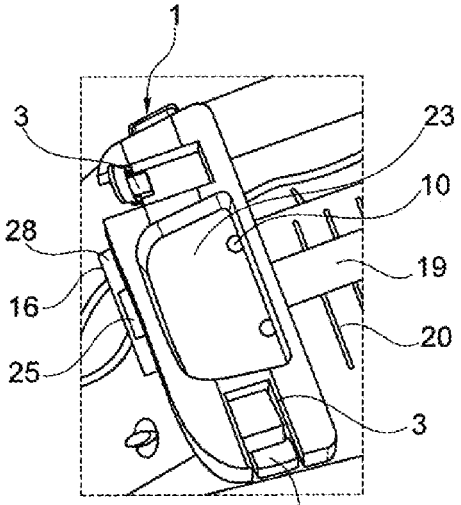
Figure 8:
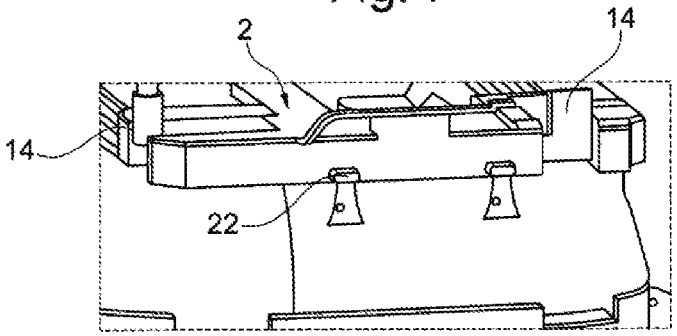
Figure 9:
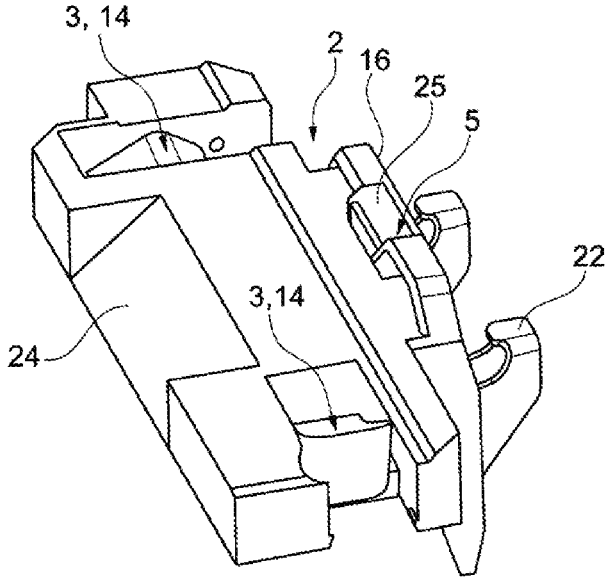
Figure 10:
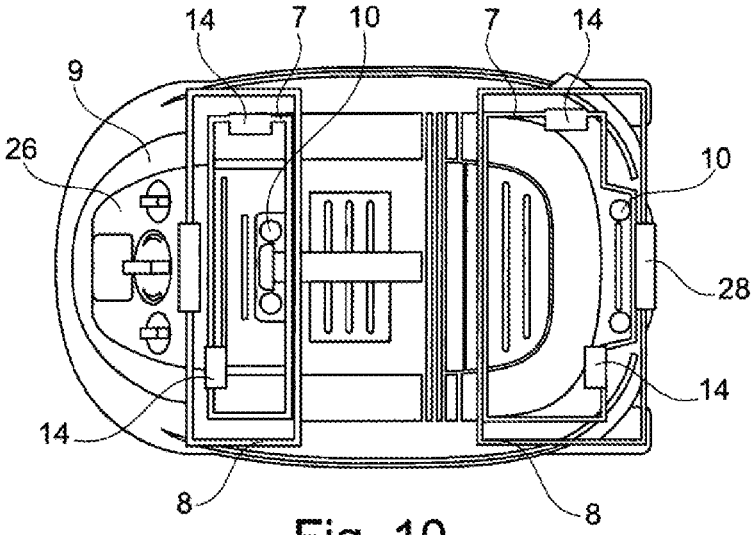
Figure 11A:
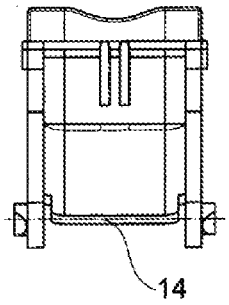
Figure 11B:
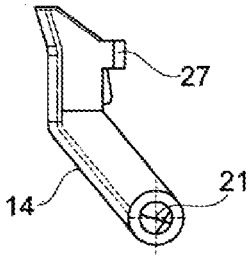
Figure 11C:
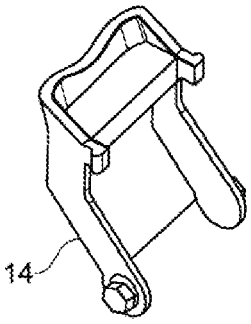
Figure 12:
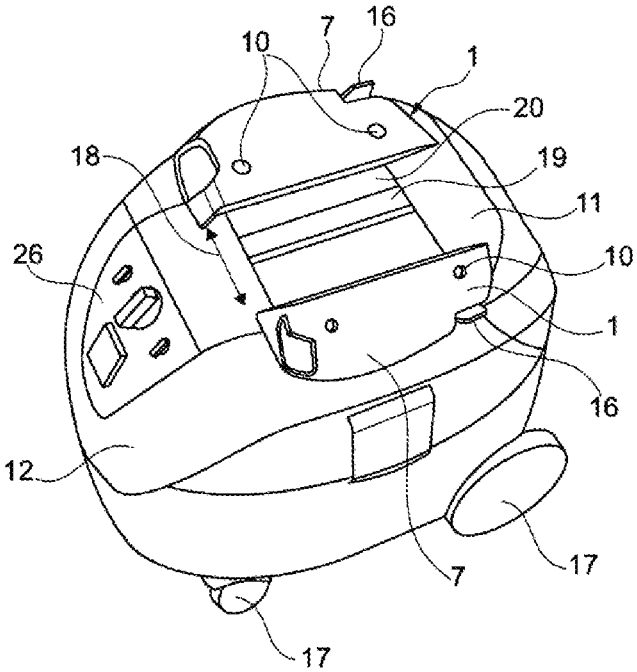
Figure 13:
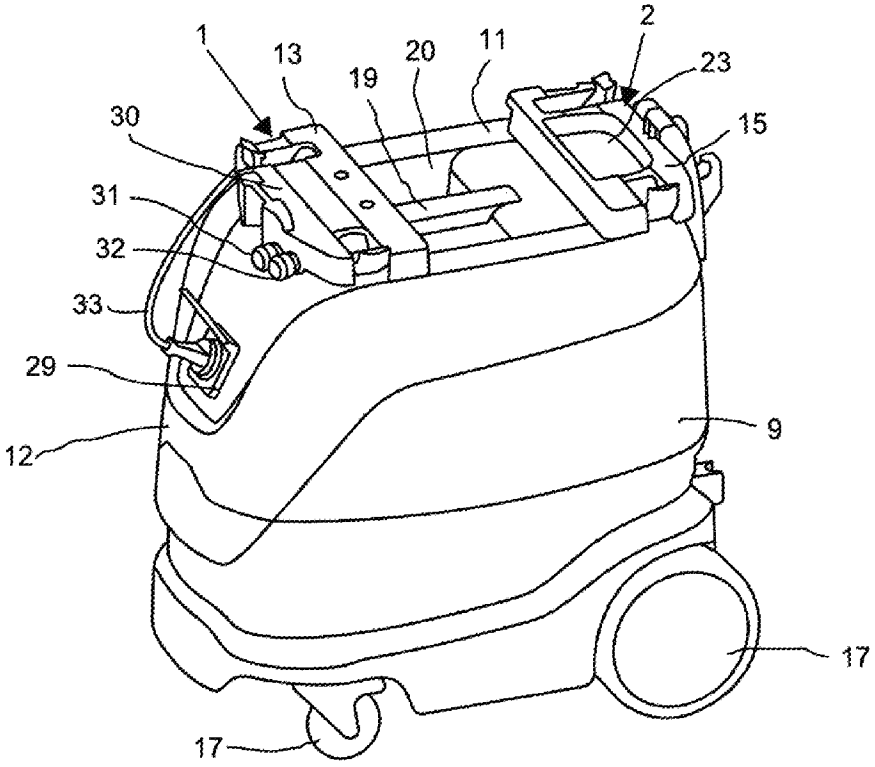

FIG. 5 shows a side view of a cleaning device with a mounted split adapter plate and a small container FIG. 6 shows a perspective view of a split adapter plate FIG. 7 shows a detailed view of a front adapter plate FIG. 8 shows a detailed view of a rear adapter plate FIG. 9 shows a perspective view of a rear adapter plate FIG. 10 shows a view from above of the receiving regions FIGS. 11*a* to 11*c* show connection elements FIG. 12 shows a perspective view of a split adapter plate FIG. 13 shows a perspective view of a cleaning device with a further embodiment of a mounted split adapter plate.

Figure 1:
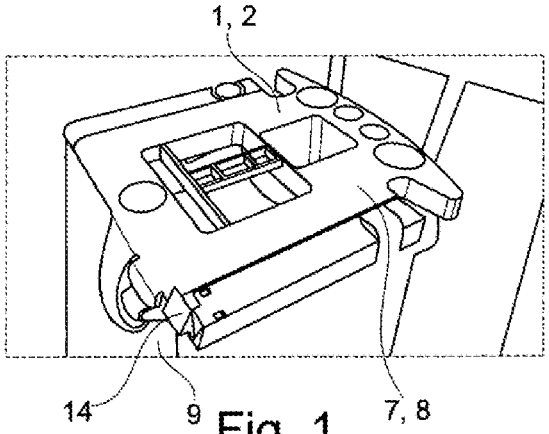
Fig. 1 (PRIOR ART)
FIG. 1 shows an adapter plate according to the state of the art

FIG. 1 shows an integral adapter plate 1, 2 according to the known art. This adapter plate is mounted on a cleaning device, for example, a vacuum cleaner 9, and has a receiving region 7, 8 for receiving containers. These containers are fixed on the adapter plate 1, 2 by means of connection elements 14.

Figure 2:
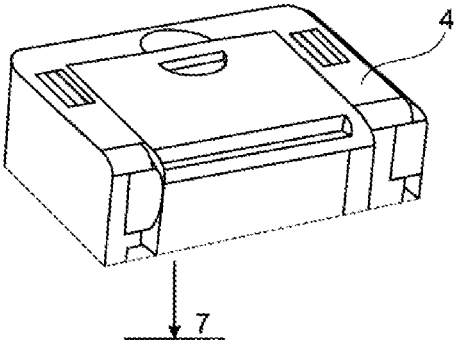
FIG. 2 shows a small mountable container

FIG. 2 shows a smaller mountable container, which may be provided for housing electrical appliances, for example.

Figure 3:
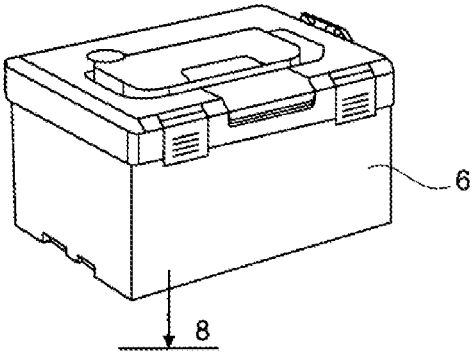
FIG. 3 shows a large mountable container

FIG. 3 shows a larger container, which may also be used for housing electrical appliances. These may be electrical appliances, for example, which cooperate with the vacuum cleaner. A grinding machine may for instance be provided, wherein the grinding dust is sucked by the vacuum cleaner through a corresponding tube connection.

Figure 4:
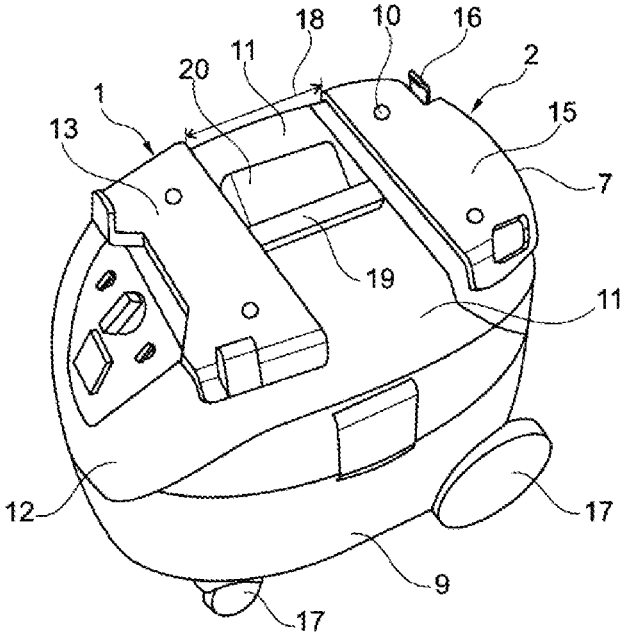
FIG. 4 shows a perspective view of a split adapter plate

FIG. 4 shows an inventive split adapter plate, which is mounted on a v9. The v9 may roll on the ground by means of wheels 17. On the upper face 11 of the device housing 12 a front adapter plate 1 and a rear adapter plate 2 are positioned. The adapter plate 1 is set at a distance 18 from the adapter plate 2. In this way a region of the upper face 11 of the cleaning device 9 covering the distance 18 between the adapter plates 1, 2 is freely visible and accessible. In this region a transport handle 19 is placed, wherein a gripping recess 20 is provided under this transport handle 19. This gripping recess 20 facilitates the gripping of the transport handle 19. The front adapter plate 1 has a support surface 13 and the rear adapter plate 2 has a support surface 15 on respective upper face for supporting a container 4, 6. The adapter plate 1 and the adapter plate 2 are mounted, through a screwed connection 10, on the upper face 11 of vacuum cleaner. Mounting of the adapter plates 1, 2 is also possible in the direction of the longitudinal axis so that, as shown in FIG. 12, these are parallel to transport handle 19. The adapter plates are placed here at a distance 18 from each other, in order to provide direct access to the transport handle 19 of the cleaning device 9.

The view of FIG. 5 shows how a small container 4 may be mounted on the split adapter plates 1, 2. The container 4 abuts against abutments 16 and is therefore held in place.

FIG. 6 shows how the front adapter plate has an arcuate part 28 in the front region, in which a locking groove 25 is positioned. Also the rear adapter plate 2 has an arcuate part 28, in which a locking groove 25 is also positioned. The invention should not be limited to the fact that in both adapter plates a locking groove is provided, optionally a locking groove 25 may be provided in only one adapter plate. This locking groove 25 allows locking a container, wherein the container has a corresponding locking protrusion, which, in case of positioning on the adapter plates, engages the corresponding locking groove and therefore fixes the container on the upper face 11 of the vacuum cleaner. The transport handle 19 is freely accessible, and is positioned between the adapter plates 1 and 2. The rear adapter plate 2 has an inclined surface 24, which allows an easier access to the handle 19. The front adapter plate 2 has a recess 23, which may be used for housing tools, for example. The front adapter plate 1 and the rear adapter plate 2 have also connection elements 14, which are used for fixing the containers.

In the configuration of FIG. 6, two different container sizes may be accommodated by the adapter plate 1, 2. A smaller container 4 may be received in the receiving points 3, wherein the receiving points 3 have connection elements 14 for fixing the container 4. It is also possible to receive larger containers 6, which because of their length contact the arcuate parts 28 and engage the locking grooves 25 through locking protrusions provided on the containers. Optionally, these containers may also be fixed through the connection elements 14. The rear adapter plate 2, which is shown in FIG. 8, also has receptacles 22, which may house a cable, for example. On the left side of the adapter plate 2 a connection element 14 is also provided, as well as a further connection element 14 on the front face, which are offset from each other by an angle of 90 degrees. The invention is not limited to this case. It is also possible to position at least two connection elements facing each other or at least two connection elements along a line of the respective adapter plate, in order to fix a container positioned on the adapter plate.

It is preferred if the respective connection elements 14 of one adapter plate 1 are diametrically opposed to the connection elements 14 of the opposing adapter plate 2. This ensures a secure fixing of the container mounted on the same.

In FIG. 7 the connection elements 14 are also positioned at an angle of 90 degrees. The adapter plate 1 also has a recess 23 for housing tools and small parts. The handle 19 is freely accessible on one side of the adapter plate 1. FIGS. 7 and 9 show the respective arcuate part 28 of the front adapter plate 1 and rear adapter plate 2. The arcuate part 28 has a locking groove 25 in which a corresponding locking protrusion of a container may engage. FIG. 9 shows the inclined surface 24 directed towards the central part of the vacuum cleaner. Therefore there are less edges, which hinder a manual handling of the transport handle.

FIG. 10 shows the small receiving region 7 as well as the larger receiving region 8, wherein the receiving region 7 is for housing a small container 4 and the receiving region 8 for a larger container 6. The receiving region 8, which is split in two, like the region 7, and which is defined by the front 1 and the rear adapter plate 2, has on its outer area a respective arcuate part 28. The arcuate part 28 allows, with its locking groove 25, the receiving of a large container 6, which is provided with corresponding locking protrusions, which engage the locking grooves 25, thereby fixing and connecting the container to the adapter plate 1, 2.

The receiving region 7 has on its front and width side a respective connection element 14, which in the example of FIG. 10 is diametrically opposed, so that the respective connection elements 7 are aligned to and facing the respective adapter plates 1, 2 in the lower area of the figure, and are positioned along a line in the upper part. The invention is not limited to this case. It may also be envisaged that the respective connection elements are mutually offset and opposed on both adapter plates 1, 2 in order to ensure a secure fixing of the respective container. In the front area of the cleaning device 9 a control panel 26 is provided, which, due to the inventive small size of the front adapter plate 1 is easily accessible without being covered by the same.

FIGS. 11A to 11C show an embodiment of the connection elements 14, which are rotatably supported by a rotation axis 21. The connection element is therefore supported in a tiltable way on the adapter plate 1, 2 between a locked and a free position. The connection elements are provided by locking hooks and engage in the locking protrusion 27 in a corresponding recess of containers 4, 6.

FIG. 13 shows another form of a split adapter plate according to the invention, with a front adapter plate 1 and a rear adapter plate 2, which are mounted on a cleaning device, a vacuum cleaner 9, for example. The vacuum cleaner 9 is movable on wheels 17 on the ground. On the upper face 11 of the apparatus housing 12 a front adapter plate 1 and a rear adapter plate 2 are disposed. The area of the upper face 11 of the cleaning device 9 between both adapter plates 1, 2 is freely viewable and accessible. In this area a transport handle 19 is positioned, wherein underneath the handle 19 a grip recess 20 is provided. The front adapter plate 1 has a support surface 13 and the rear adapter plate 2 has a support surface 15 for placing a container (FIGS. 2 and 3) on the same. The adapter plate 1 and the adapter plate 2 are screwed to the upper face 11 of the vacuum cleaner, for example.

The rear adapter plate 2 may be provided with one or more recesses 23, in which objects like screws, coins, accessories, etc., may be stored.

The front adapter plate 1 may be provided, for example, with an external or integral cable receptacle, which houses the electric cable of the cleaning device 9 or the electric cable of an electric auxiliary apparatus.

The front adapter plate 1 may also contain an electric auxiliary apparatus 30, for example, an air compressor for generating compressed air with an inlet 31 and an outlet 32 for air, or a high pressure pump for generating a high pressure cleaning beam with an inlet 31 and an outlet 32 for water. The electric auxiliary apparatus 30 positioned in the adapter plate 1 has an electric cable 33, which may be inserted in an electric socket 29, which is provided on the control panel 26 of the cleaning device 9. In this way, the electric auxiliary apparatus 30 is electrically powered in the adapter plate 1 by the cleaning device 9. It may also be envisaged that the socket 29 is electrified once the cleaning device is connected to the electric grid. It may also be envisaged that the socket 29 is supplied with power once the cleaning device 9 is switched on. In the same way, a separate on/off switch may be provided for on/off switching of the socket 29.

Obviously, various other electric appliances may be connected to the electric socket 29.

It is therefore important, in the present invention, that an easy control and handling of the vacuum cleaner is ensured, due to the fact that the adapter plate is at least split in two parts so that the vacuum cleaner may be better controlled and, while keeping the same adapter plate size, at least two different receiving areas, according to container size, are available.

LIST OF REFERENCES

1 front adapter plate
2 rear adapter plate
3 attachment points for 4
4 container small
5 attachment points for 6
6 container large
7 receiving area
8 receiving area
9 cleaning device/vacuum cleaner
10 screw connection
11 upper face
12 device housing
13 support surface front
14 connection element
15 support surface rear
16 abutment
17 wheel
18 distance
19 transport handle
20 handle recess
21 rotation axis
22 receptacle
23 recess
24 inclined surface
25 locking groove
26 control panel
27 locking protrusion
28 arcuate part
29 electric socket
30 electric auxiliary apparatus
31 inlet
32 outlet
33 electric cable

The invention claimed is:

1. An adapter device for arranging a container on the upper face of a cleaning device, said adapter device being composed of a first adapter plate and a separate second adapter plate configured to be connected to the upper surface of the cleaning device, each of the first and second adapter plates having a support surface opposite to a surface of the respective first or second adapter plate which faces the upper surface of the cleaning device and at least one locking element configured to lock the container in place on the support surface of the respective first or second adapter plate, wherein the first adapter plate and the second adapter plate are configured to be separately mounted on the upper face of the cleaning device, and wherein the first and second adapter plates are spaced apart from one another on the upper surface with no connecting pieces and such that the upper surface and a transport handle disposed on the upper surface are both freely accessible and exposed between the first and second adapter plates.

2. The adapter device according to claim 1, wherein the transport handle of the cleaning device is disposed and freely accessible in the space between the first and second adapter plates.

3. The adapter device according to claim 1, wherein the container is configured to be fixed to the support surface by connection elements.

4. The adapter device according to claim 1, wherein the support surface has at least two differently sized receiving areas, for receiving containers in different sizes.

5. The adapter device according to claim 1, wherein the at least one locking element of the first adapter plate has an arcuate part, in which a locking groove for locking with the container is disposed.

6. The adapter device according to claim 1, wherein the at least one locking element of the second adapter plate has an arcuate part, in which a locking groove for locking with the container is disposed.

7. The adapter device according to claim 1, wherein the first and second adapter plates are configured to be screwed to an upper face of the cleaning device by screw connections.

8. The adapter device according to claim 1, wherein at least one of the first adapter plate or the second adapter plate has a receptacle for housing a tube or a cable.

9. The adapter device according to claim 1, wherein at least one of the second adapter plate has an inclined surface, which facilitates gripping of the transport handle.

10. The adapter device according to claim 1, wherein at least one of the first adapter plate or the second adapter plate has a recess for housing objects.

11. The adapter device according to claim 1, wherein at least one of the first adapter plate or the second adapter plate comprise an electrically driven auxiliary apparatus.

12. The adapter device according to claim 11, wherein the electric auxiliary apparatus is supplied with electric current through a socket which is disposed on the cleaning device.

13. The adapter device according to claim 1, wherein the transport handle extends from the upper face of the cleaning device and is configured to be freely accessed in the space between the first and second adapter plates.

14. A cleaning device comprising an upper surface, a transport handle extending from the upper surface, and an adapter device comprising a first adapter plate and a separate second adapter plate configured to be connected to the upper surface of a cleaning device, each of the first and second adapter plates having a support surface and at least one locking element for locking the container in place on the support surface of the respective first or second adapter plate, wherein the first adapter plate and the second adapter plate are configured to be separately mounted on the upper face of the cleaning device, and wherein the first and second adapter plates are connected to the upper surface at a defined space apart from one another such that the upper surface and a transport handle disposed on the upper surface are both freely accessible and exposed in the defined space between the first and second adapter plates.

* * * * *